US006604909B2

(12) United States Patent
Schoenmeyr

(10) Patent No.: US 6,604,909 B2
(45) Date of Patent: Aug. 12, 2003

(54) DIAPHRAGM PUMP MOTOR DRIVEN BY A PULSE WIDTH MODULATOR CIRCUIT AND ACTIVATED BY A PRESSURE SWITCH

(75) Inventor: Ivar L. Schoenmeyr, San Juan Capistrano, CA (US)

(73) Assignee: Aquatec Water Systems, Inc., Irvine, CA (US)

( * ) Notice: Subject to any disclaimer, the term of this patent is extended or adjusted under 35 U.S.C. 154(b) by 0 days.

(21) Appl. No.: 09/819,536

(22) Filed: Mar. 27, 2001

(65) Prior Publication Data

US 2002/0141874 A1 Oct. 3, 2002

(51) Int. Cl.[7] ..... F04B 49/10
(52) U.S. Cl. ..... 417/32; 417/44.2; 417/53
(58) Field of Search ..... 417/32, 42, 44.2, 417/44.11, 53, 413.1; 60/452

(56) References Cited

U.S. PATENT DOCUMENTS 4,180,375 A * 12/1979 Magnussen, Jr. ..... 417/22
4,527,953 A * 7/1985 Baker et al. ..... 417/63
4,625,158 A * 11/1986 Taenzer ..... 318/701
4,863,355 A * 9/1989 Odagiri et al. ..... 417/12
5,520,517 A * 5/1996 Sipin ..... 417/44.3
6,074,170 A * 6/2000 Bert et al. ..... 417/44.2
6,092,992 A * 7/2000 Imblum et al. ..... 417/42
6,164,933 A * 12/2000 Tani et al. ..... 417/413.2
6,200,101 B1 * 3/2001 North, Jr. ..... 417/36
6,254,353 B1 * 7/2001 Polo et al. ..... 417/44.11

* cited by examiner

*Primary Examiner*—Charles G. Freay
*Assistant Examiner*—Han L Liu
(74) *Attorney, Agent, or Firm*—Irell & Manella LLP

(57) ABSTRACT

A pump assembly that has a control circuit and a pressure switch which control the operation of a pump motor. The motor drives a positive displacement pump that is coupled to a fluid system. The control circuit includes a pulse width modulator circuit. The control circuit is activated when a pressure switch senses that a line pressure of the fluid system is below a threshold value. The control circuit can either operate in a continuous mode to provide a constant signal to the motor, or a pulse regulating mode to provide a series of pulses to the motor. The pulses begin with a minimum width and gradually increase until a predetermined current limit has been attained, or the motor reaches a full speed with the control circuit in a continuous on state. The speed of the motor will then correspond to the flow demanded by the fluid system. The energy provided by the pulses is varied as a function of changes in peak current drawn by the motor. The peak current is sensed and used to determine the pulse width. Changing the pulse energy varies the speed of the motor.

21 Claims, 6 Drawing Sheets

DIAPHRAGM PUMP MOTOR DRIVEN BY A PULSE WIDTH MODULATOR CIRCUIT AND ACTIVATED BY A PRESSURE SWITCH

BACKGROUND OF THE INVENTION

1. Field of the Invention

The present invention relates to a pump assembly.

2. Background Information

Pumps are typically used to pump fluid through a hydraulic system. Pumps have a performance curve that characterizes the pump flow output at a predetermined back-pressure. There are different types of pumps which each have certain characteristics and advantages. For example, recreational vehicles typically have a diaphragm pump that pumps water from a storage tank to faucets, showers, etc. Diaphragm pumps are advantageous because such devices are self-priming, can run dry, and more efficiently generate demanded flow and pressure from the water system in a recreational vehicle. The pump and motor are typically sized to meet the maximum anticipated demand of the water system. By way of example, the maximum demand in a recreational vehicle may occur when all of the faucets are open.

The diaphragm pump is driven by a motor coupled to a pressure switch that senses the pressure within the water line. The pressure switch is typically designed to turn on at a low pressure and turn off at a higher pressure.

When the water pressure falls below a threshold value the pressure switch activates the motor to drive the pump. The pump then pumps water according to a pump performance curve shown in FIG. 1. As shown in FIG. 1, the range of flowrates between the on and off pressures is relatively limited. When the demand for water is less than the minimum flowrate, the pump will cycle between on and off states to maintain the water pressure within the system. Cycling reduces the life of the pump. Cycling also creates undesirable fluctuations in flow. For example, the pump may be in a water system where a cold faucet and a hot faucet are partially open. Given different dynamics of each line, the flow fluctuations created by a cycling pump may create undesirable variations in water temperature.

Some systems incorporate accumulators that can store the output of the pump and reduce the number of pump cycles. Acculumators are bulky and add to the cost of the system.

Some diaphragm pumps include by-pass valves that allow continuous pump operation when the line pressure has reached a desired level. Such an approach is not energy efficient because as actual demand decreases, an increasing amount of energy is required to re-circulate water within the pump. It is also difficult to reliably generate the higher pressure needed to deactivate the pressure switch when there is no demand for water.

Most water pumps are positive displacement devices that theoretically generate the same flowrate regardless of the line pressure. To insure that water can be provided to all of the faucets, etc, the pump is configured to always operate at a maximum power given a maximum flowrate. The hydraulic system does not always need the maximum flowrate. There is an inefficiency in operating a pump in this manner. It would be desirable to provide a positive displacement pump that can operate continuously over a wide range of flows and vary the pump output as a function of the line pressure within the system.

Additionally, the prior art pumps start up at full power and turn off at full power. Starting and stopping at full power can create a shock in the system (waterhammer). This shock stresses the system and may produce an undesirable audible noise. It would be desirable to provide a pump that ramps up to a desired flow and gradually reduces power before turning off.

BRIEF SUMMARY OF THE INVENTION

One embodiment of the present invention is a pump assembly that includes a pulse width modulator circuit. The pulse width modulator circuit generates a series of pulses that drive a motor. The motor drives a positive displacement pump that creates an output pressure. The circuit can sense variations in the motor current of the motor and change the energy provided by the pulses as a function of the varying current. A pressure switch activates and deactivates the pulse width modulator circuit.

DETAILED DESCRIPTION OF THE PREFERRED EMBODIMENT

In general the present invention includes a pump assembly that has a control circuit and a pressure switch which control the operation of a pump motor. The motor drives a positive displacement pump that is coupled to a fluid system. The control circuit includes a pulse width modulator circuit. The control circuit is activated when a pressure switch senses that a line pressure of the fluid system is below a threshold value. The control circuit can either operate in a continuous mode to provide a constant signal to the motor, or a pulse regulating mode to provide a series of pulses to the motor.

The pulses begin with a minimum width and gradually increase until a predetermined current limit has been attained, or the motor reaches a full speed with the control circuit in a continuous on state. The speed of the motor will then correspond to the flow demanded by the fluid system. The energy provided by the pulses is varied as a function of changes in peak current drawn by the motor. The peak current is sensed and used to determine the pulse width. Changing the pulse energy varies the speed of the motor.

In general the pulse width and thus pulse energy is reduced with sensed increases in the peak motor current. The lower pulse energy slows down the motor. Thus the pump will slow down and reduce output flow with increasing output pressure. The output flow of the pump can thus vary proportionately to demand. If the pressure exceeds an upper threshold value, the pressure-switch deactivates power to the control circuits to turn off the pump.

Figure 2:
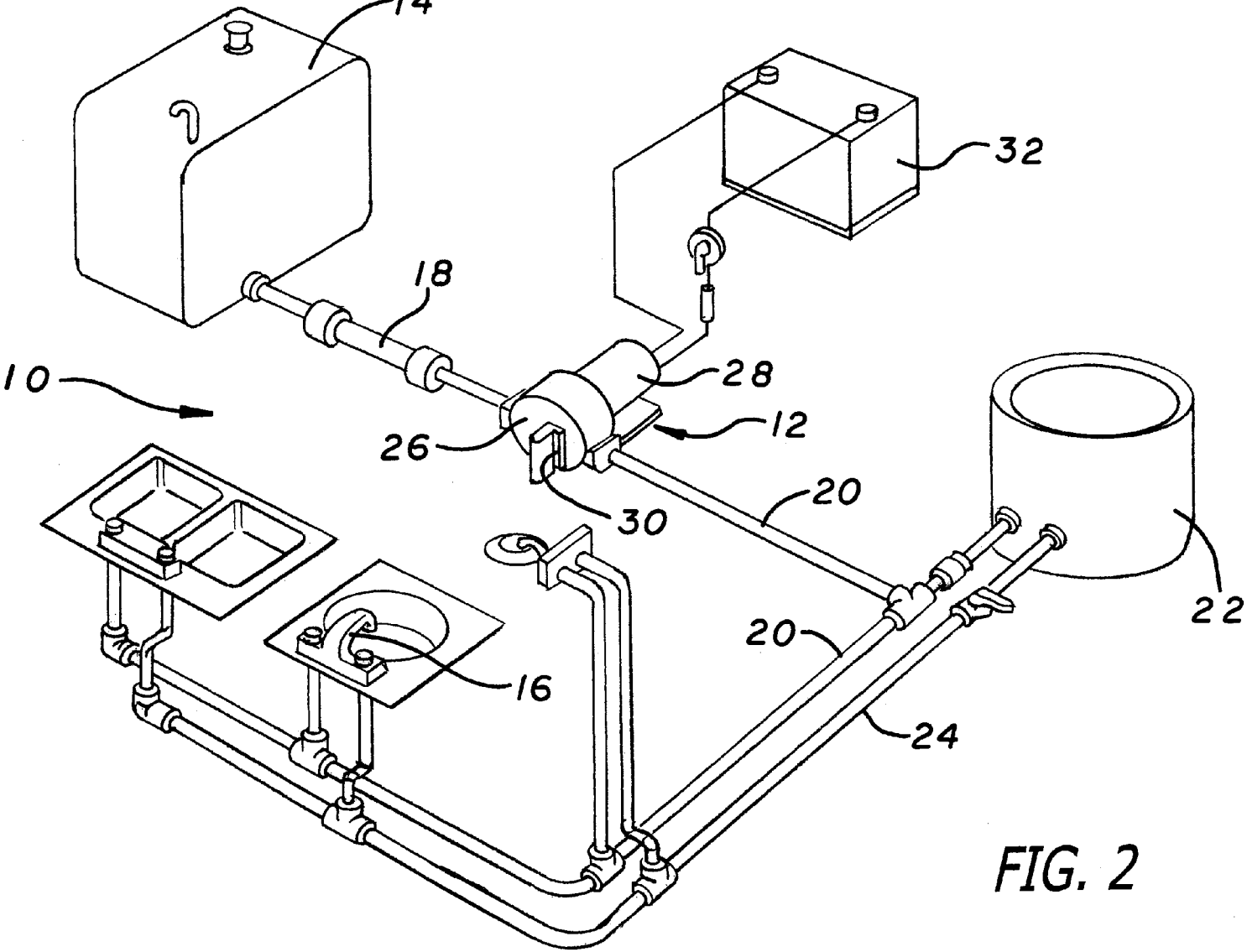
FIG. 2 is a schematic of an embodiment of a hydraulic system of the present invention.

Referring to the drawings more particularly by reference numbers, FIG. 2 shows an embodiment of a hydraulic system 10 of the present invention. By way of example, the hydraulic system 10 may be a water supply for a recreational vehicle. The hydraulic system 10 includes a pump assembly 12 that is coupled to a fluid tank 14 and one or more fluid valves 16. The system 10 may also include a filter 18 located between the fluid tank 14 and the pump assembly 12. The fluid valves 16 may be faucets, shower heads, etc. The pump 12 may be connected to the fluid valves 16, filter 18 and fluid tank 14 by fluid lines 20. By way of example, the fluid lines 20 may provide a "cold" water line. The system 10 may also include a heater 22 that is connected to the cold line 20 and a separate "hot" water line 24.

The pump assembly 12 may include a pump 26 and a motor 28. The motor 28 is controlled by a control circuit 30 attached to the pump 26. The motor 28 and control circuit 30 are connected to a battery 32. The pump 26 is preferably a positive displacement diaphragm device. The motor 28 is preferably a DC permanent magnet brush commutated motor. The impedance of a DC permanent magnet brush commutated motor is proportional to the speed of the rotating motor armature. The impedance will generally increase with an increase in motor speed. When a pulse having a constant voltage (the battery voltage) is provided to the motor, the amperage will be equal to the fixed voltage divided by the variable impedance. The current drawn by the motor will decrease with an increase in motor speed and vice versa.

The pump assembly 12 must provide a minimum pressure to overcome pressure losses created by the pipes, heater, filters, etc. so that a desired fluid velocity is generated at the fluid valves 16. A speed reduction of the motor 28 is not desirable if the pressure is below the minimum pressure. The control circuit 30 is configured to allow continuous power to the motor 28 if the pressure is below the minimum pressure point.

Figure 3:
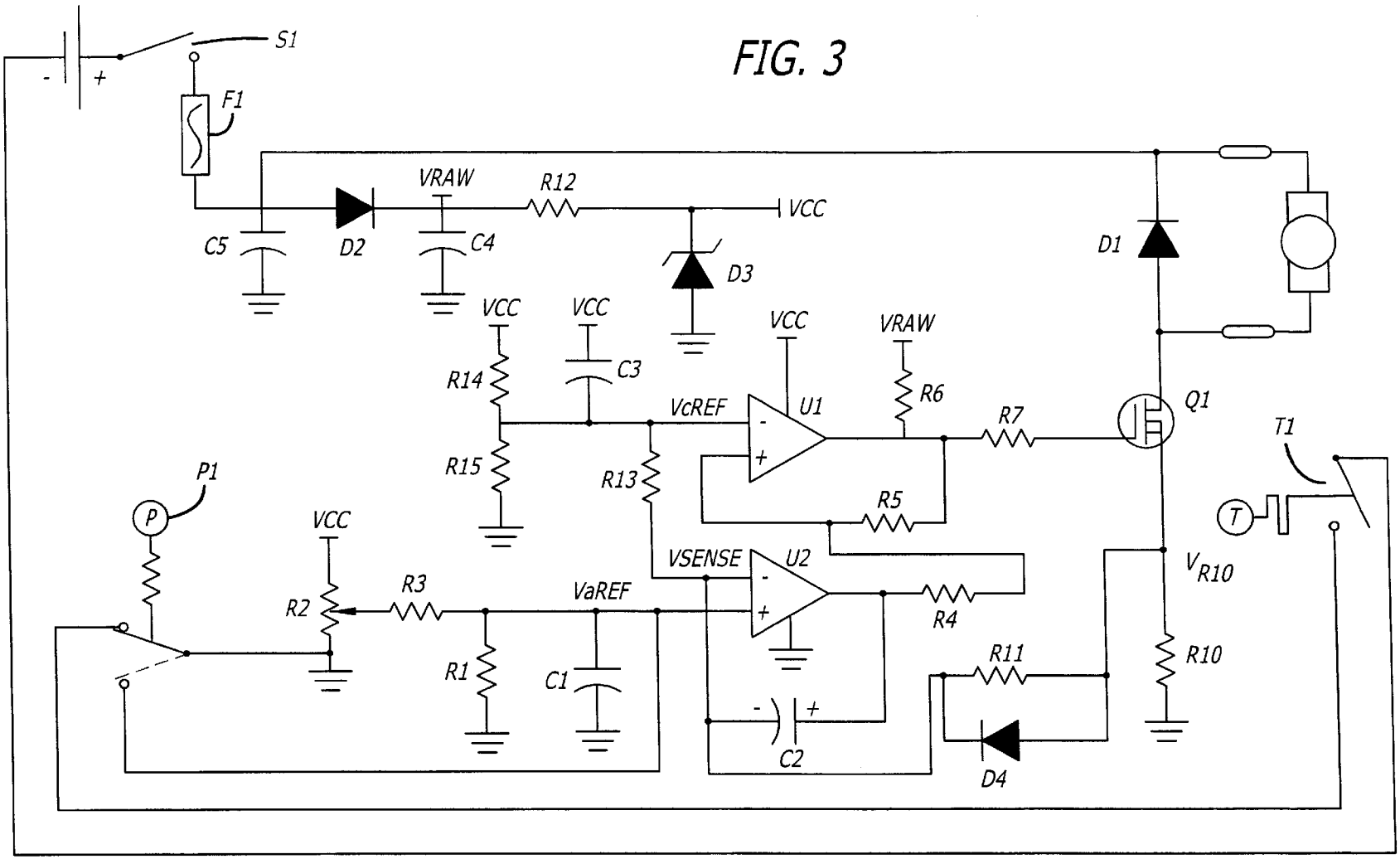
FIG. 3 is a schematic of a control circuit for a pump motor of the hydraulic system.

FIG. 3 shows an embodiment of a control circuit 30 of the present invention. The control circuit 30 includes a comparator U1, an operational amplifier U2, a transistor Q1, diodes D1–D4, capacitors C1–C5 and resistors R1–R15.

The control circuit 30 provides a series of pulses to the motor 28 by turning the transistor Q1 on and off. Alternatively, the control circuit 30 can drive the transistor Q1 continuously on so that a constant signal is provided to the DC permanent magnet brush commutator motor 28. The pulses provide energy to drive the motor 28. The diode D1 allows the back emf current of the motor 28 to flow when the transistor Q1 is off. The battery 32 is connected to the control circuit 30 by a manual on/off switch S1 and a fuse F1. Diode D3 is typically a zener type device which establishes the voltage Vcc. The output of diode D2 establishes the voltage Vraw that drives the transistor Q1.

The battery 32 is also coupled to the control circuit 30 by a pressure switch P1 and a thermal breaker T1. The thermal breaker T1 senses the temperature of the control circuit 30. If the temperature exceeds a threshold value the breaker T1 opens and power to the control circuit 30 and motor 28 is terminated. The breaker T1 can terminate current if the motor 28 stalls and heats up (low voltage condition of the battery).

The pressure switch P1 functions as an on/off switch for the control circuit 30. The pressure switch P1 senses the line pressure at the output of the pump 26. The pressure switch P1 may be a single pole double throw switch. When the pressure is less than a threshold value, the switch P1 is in the position shown, such that power is provided to the control circuit 30. When the pressure equals or exceeds the threshold pressure the switch P1 moves to the position shown in phantom so that power is interrupted to the control circuit 30.

The comparator U1 may provide a high output when the input at the positive terminal is higher than the input at the negative terminal. The high output will turn on the transistor Q1 and allow current to flow through the motor 28. When the positive terminal is lower than the negative terminal, the comparator U1 output will switch to a low state and turn off the transistor Q1. Current from the power source 32 will not flow through the motor 28 when the transistor Q1 is turned off. The comparator U1 may be constantly high, allowing continuous current to the motor or, provides a series of high and low outputs to turn the transistor on and off and create pulses to drive the motor 28.

Resistors R14 and R15 may have values that provide a voltage to the negative terminal of the comparator U1 that is essentially Vcc/2. For example, if the zener diode D3 is 6.8 volts ("V") then the voltage Vcref at the negative terminal of comparator U1 would be 3.4 V. The positive terminal of the comparator U1 is connected to the output of the amplifier U2 through resistor R4, and with the output of the comparator U1 through resistor R5. Feeding back the output to the input, latches the output signal of the comparator U1.

The positive terminal of the amplifier U2 is connected to the resistors R1–R3 and capacitor C1. The voltage Varef at the positive terminal establishes a reference voltage for the amplifier U2. R2 is a variable resistor that can be adjusted to vary the reference voltage Varef and establish a maximum motor current at which U1 transitions from a continuous mode to a pulsating regulation mode. The maximum current is set to establish a minimum system pressure. It is desirable to establish a minimum speed so that the motor 28 does not stall before a maximum desirable pressure has been attained by the system. Resistor R11, capacitor C2 and diode D4 establish the minimum energy pulse width corresponding to the minimum speed of the motor.

When the fluid pressure falls below the threshold value and the switch is moved to the position shown in FIG. 2, the capacitor C1 will charge so that Varef will gradually increase. This will cause the motor speed to also gradually increase. Such a technique provides a "soft start" that prevents sudden surges to the system. By way of example, the capacitor C1 may have a value so that it is approximately 3 seconds before the motor can run at a constant speed. The capacitor C1 discharges instantly when the pressure switch P1 switches to the position shown in phantom so that the soft start function is provided each time the motor is turned off and then on.

The voltage Vsense at the negative terminal of the amplifier U2 is controlled by the voltage at resistor R11 and the time constant of capacitor C2. The output of the amplifier U2 is the difference between Varef and Vsense, multiplied by a gain of the amplifier. If the output of the amplifier U2 is greater than Vcref then the comparator U1 will provide a high output and turn on transistor Q1.

When the pressure falls below a threshold value, the switch P1 switches to the position shown in FIG. 2, to establish a voltage Varef at the positive input of the amplifier U2. The voltage Varef will turn on transistor Q1 and allow current to be drawn by the motor 28. If the current drawn by the pump motor 28 is such that the voltage Vr10 across resistor R10 is less than Varef, the transistor Q1 will stay on and the control circuit 30 will provide a continuous current to the motor 28. This is the continuous mode.

When the motor 28 draws a current so that Vr10 exceeds Varef, the control circuit 30 will provide a series of pulses to the motor 28 by turning the transistor Q1 on and off. This is the pulsating regulation mode. In this mode Vsense is approximately equal to Varef. In the pulsating regulation mode the output of U2 has small swings that latch the amplifier U1 and switch the transistor Q1 between on and off states. By way of example, R4 and R5 can be set so that the output of U2 swings between 0.98×Vcc/2 and 1.02×Vcc/2.

The current through resistor R11 and diode D4 is proportional to Vr10–Varef. When Vr10–Varef is a positive value the capacitor C2 will discharge to the voltage 0.98×Vcc/2 at which point the amplifier U1 latches and switches the transistor Q1 to an off state. When Q1 is off the capacitor C2 will charge because of the low voltage (essentially is ground) of Vr10. The capacitor C2 will charge to the voltage 1.02×Vcc/2 wherein the amplifier U1 will latch and turn on the transistor Q1. The capacitor C2 will again discharge and the process of turning the transistor Q1 on and off to create pulses will be repeated until, the pressure switch P1 switches to terminate power to the control circuit 30, or the control circuit 30 reverts to the continuous mode.

The discharge time and resultant pulse width provided to the motor 28 is a function of the voltage differential Vr10–Varef. As the motor 28 draws more current, the voltage Vr10 will increase and create a higher differential voltage Vr10–Varef. The higher differential voltage will reduce the time to discharge the capacitor C2 to the voltage level 0.98×Vcc/2 that switches the transistor Q1 off. Therefore the pulse widths will become smaller as the current demand from the motor becomes higher. The off time between the pulse widths is relatively constant and is essentially equal to Varef/R11. The capacitor C2 and resistors R4, R5 and R11 are selected so that the motor does not appreciably decelerate when the transistor Q1 is off. For example, the off time of the transistor Q1 may be set at 5 milliseconds.

The motor speed is a function of the average energy of the DC voltage applied to the motor 28. Because the voltage amplitude is constant, the width of the pulses will therefore define the average energy and the speed of the motor 28. As the motor 28 draws more current the control circuit 30 reduces the width of the pulses. The reduction in pulse width will decrease the average energy and slow down the motor 28. A reduction in current will increase the pulse widths and increase the speed of the motor 28.

When the transistor Q1 is turned off the motor 28 continues to rotate and creates a back emf voltage. In essence the motor 28 becomes a current generator. The diode D1 creates a current path for the motor 28. The back emf current is added to the current provided to the motor 28 when the transistor Q1 is on. The torque created by the pump motor 28 is function of the total averaged current provided to the motor 28. The diode D1 allows the pulse and emf currents to add so that the average current through the motor 28 increases, allowing the pump to increase output pressure when the control circuit 30 is in the pulsating regulation mode.

Figure 4:
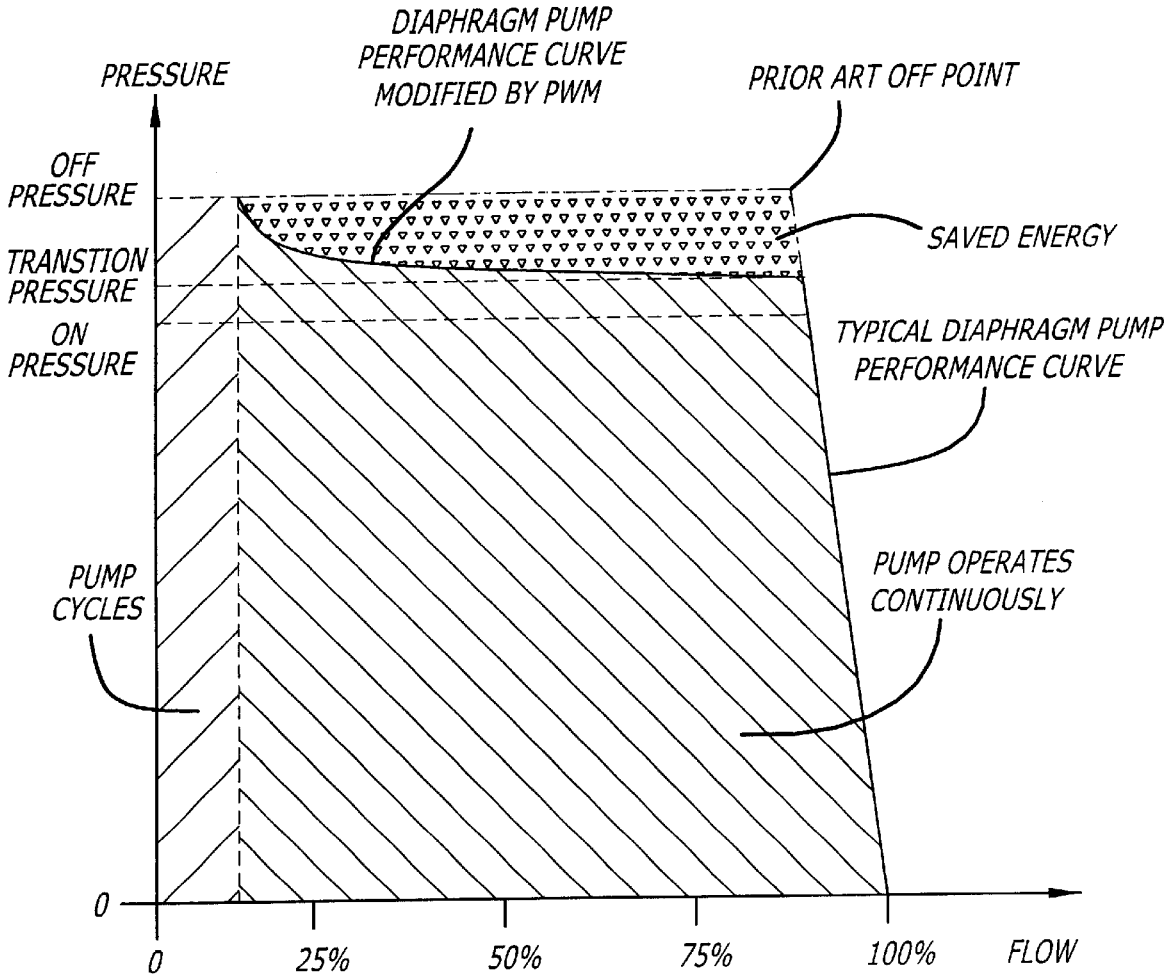
FIG. 4 is a graph showing a characteristic curve of the pump of the present invention.

Referring to FIG. 4, in operation, when the line pressure within the system falls below the lower "on", threshold value the pressure switch P1 will turn on the control circuit 30 to drive the motor 28 and pump 26. For a given flow demand the control circuit 30 may operate in the continuous mode to generate a constant motor speed.

The line pressure may reach a "transition" value wherein the control circuit 30 switches to the pulsating regulation mode. In the pulsating regulation mode the control circuit 30 will slow down the motor 28 by reducing the width of the pulses. The diode D1 allows the total average current to increase so that pump can provide a greater output pressure. The motor 28 continues to drive the pump 26 until the line pressure reaches an upper "off" pressure, wherein the pressure switch terminates power to the control circuit 30. The off pressure should be set below the stall pressure of the pump.

FIG. 4 depicts a number of advantages of the control circuit 30 over pump assemblies of the prior art. The control circuit 30 will gradually reduce the speed of the motor to the off point, instead of instantaneous pump shut off found in prior art system. Gradually slowing the motor speed will reduce the stresses on the pump assembly and the noise in the system (water hammer).

Figure 1:
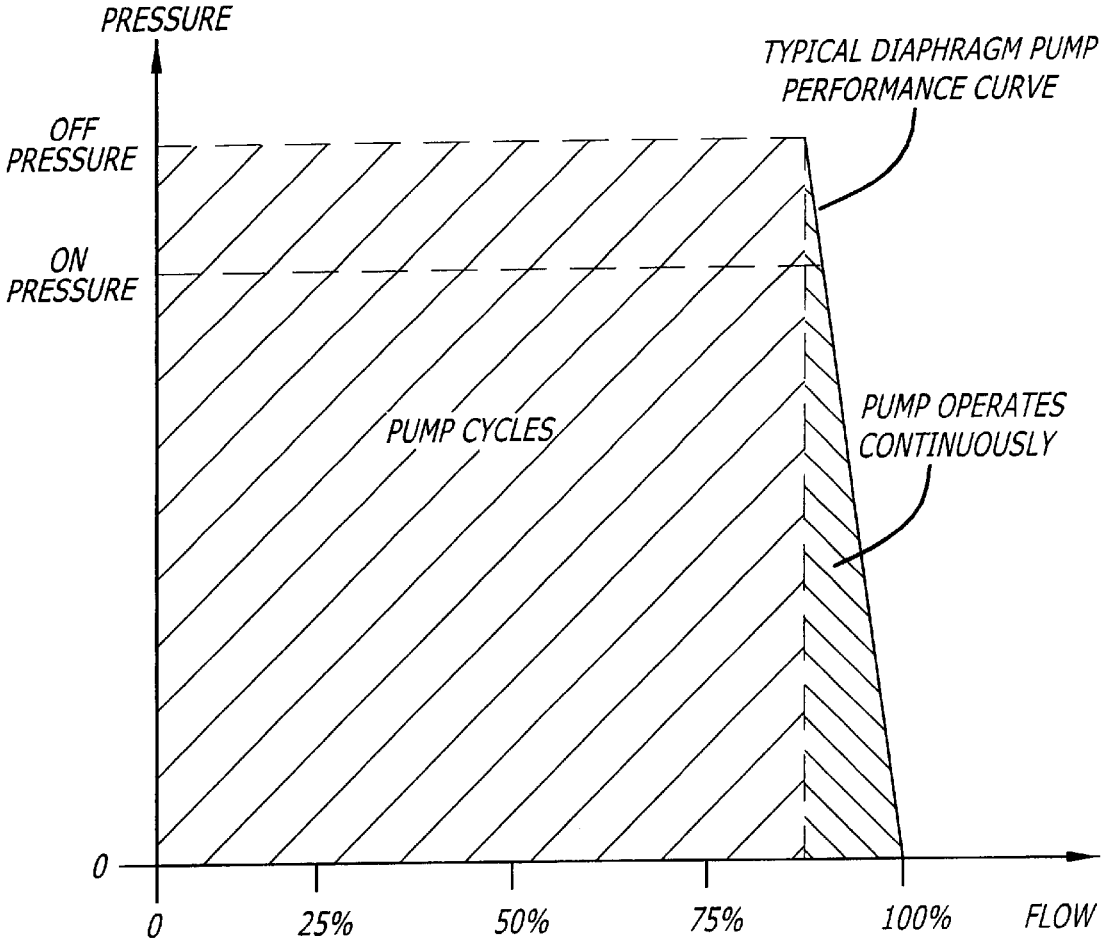
FIG. 1 (PRIOR ART)
FIG. 1 is a graph showing a characteristic curve of a prior art pump.

Additionally, as shown in FIG. 4, prior art pumps will turn off at peak pressure and a peak speed. By gradually slowing the motor speed, the pump assembly is able to save energy as shown in the cross-hatched area of the curve. When compared to FIG. 1 it can also be seen that the present invention provides a smaller pump cycle area and a larger continuous mode area. Reducing pump cycling increases the life of the pump.

Figure 5:
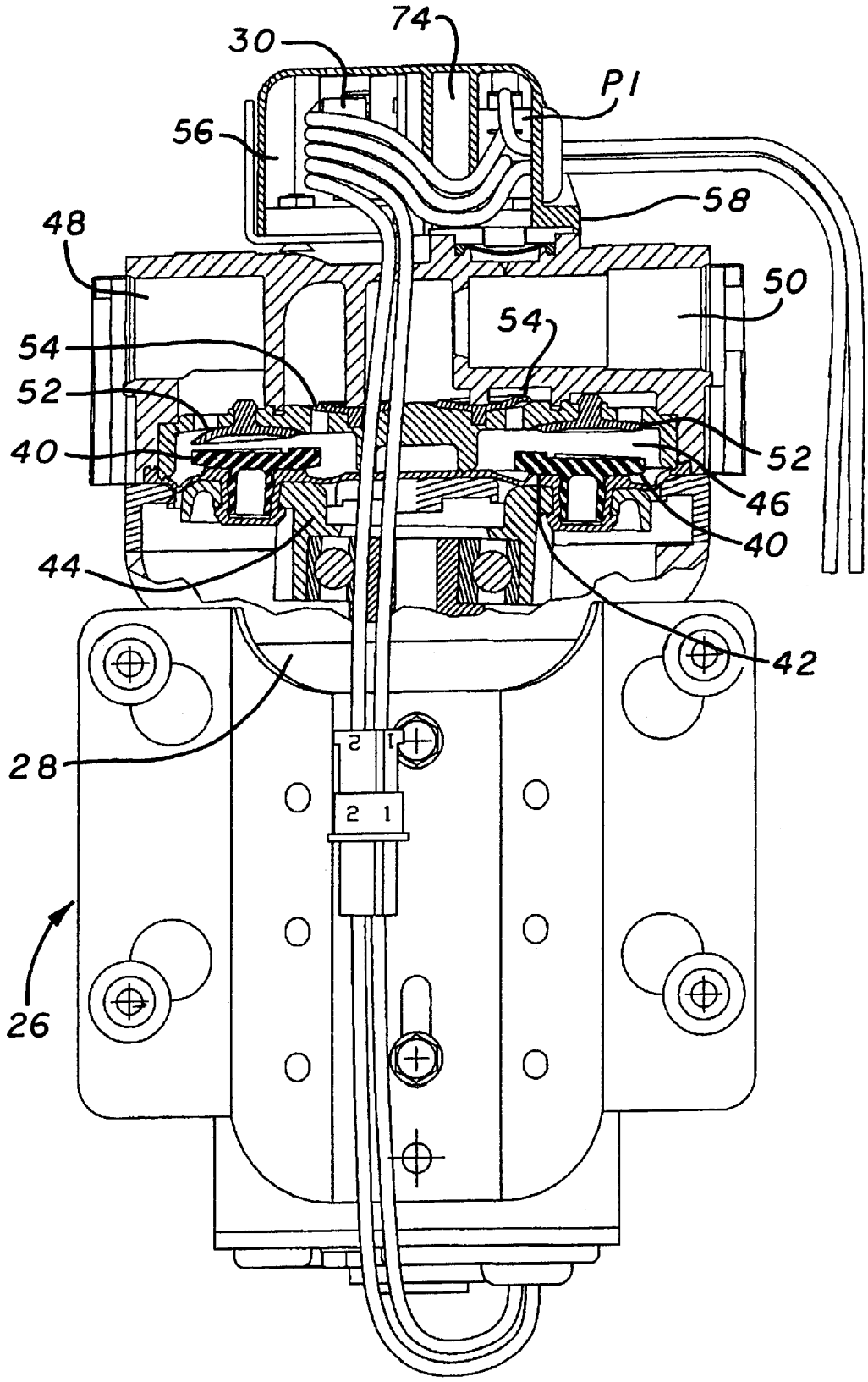
FIG. 5 is a cross-sectional view of a pump.

FIG. 5 shows an embodiment of a pump 26 of the present invention. The pump 26 includes a plurality of pump pistons 40 attached to a diaphragm 42. The diaphragm 42 is coupled to a wobble plate 44. The wobble plate 44 is rotated by the motor 28. Rotation of the wobble plate 44 will move the pump pistons 40 within pump chambers 46.

The pump 26 has inlet 48 and outlet 50 ports that are coupled to pump chambers 46 by inlet 52 and outlet 54 valves, respectively. Movement of the pistons 40 in a downward direction will create a pressure differential and pull fluid through the inlet valve 52. Movement of the piston 40 in an upward direction will force the fluid back through the outlet valve 54.

Figure 6:
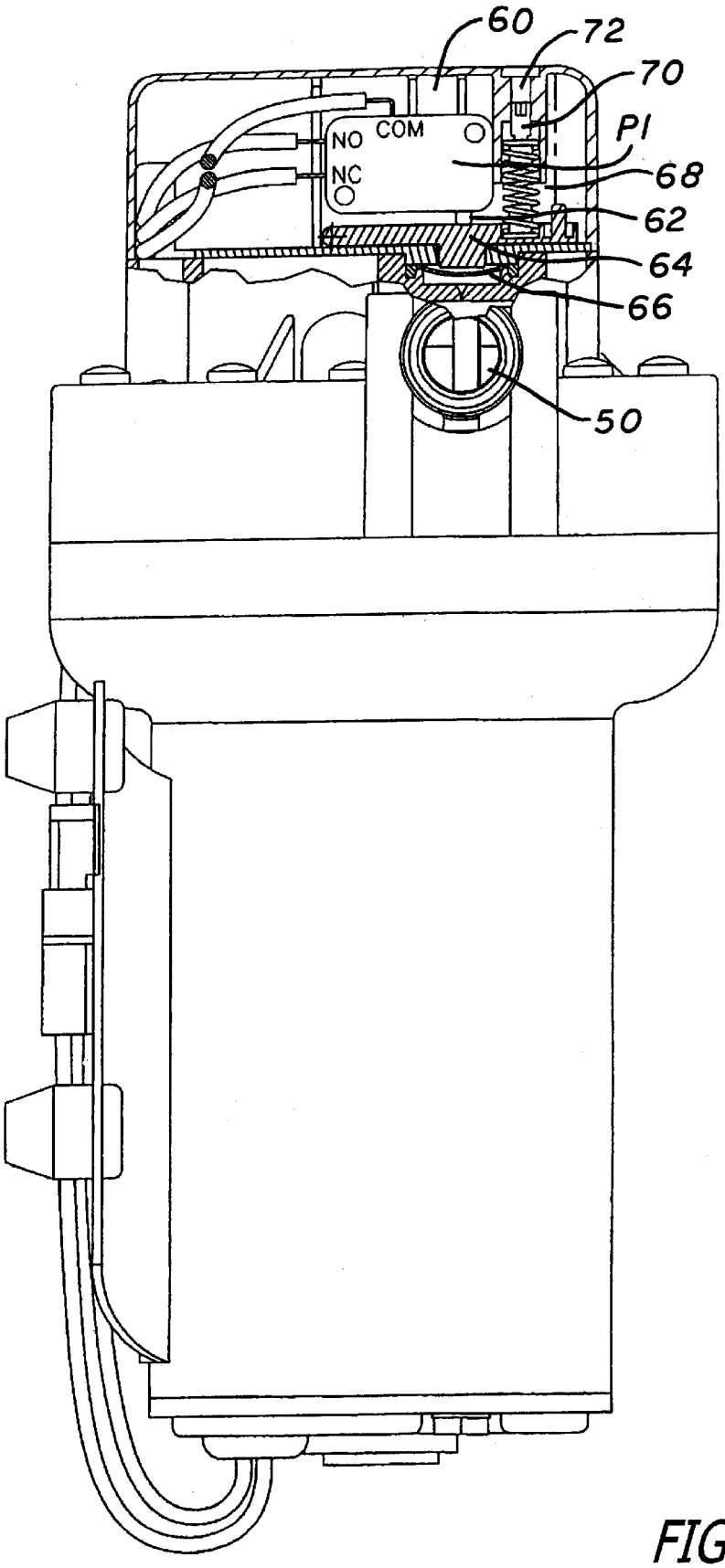
FIG. 6 is a cross-sectional view showing a control circuit located within the pump.

The control circuit 30 and pressure switch P1 are preferably attached to the pump 26. The control circuit. 30 can be potted into a first cavity 56 of a pump housing 58. As shown in FIG. 6, the pressure switch P1 can be located within a separate second cavity 60 of the housing 58. The switch P1 may be a microswitch that has an actuator button 62. The actuator button 62 may be in contact with a lever 64 that is biased into a diaphragm 66 by a spring 68. The actuator button 62 has a certain compressed position that will close the switch and turn off the pump, and an extended position that will open the switch and turn on the pump.

The spring force exerted by the spring 68 onto the lever 64 can be varied by a plunger 70 and a set screw 72. The set screw 72 allows an operator to set the upper pressure threshold at which the pump is turned off.

In operation, the diaphragm 66 will move in conjunction with changes in the water pressure. When the water pressure decreases the diaphragm 66 and lever 64 will move until the button 62 reaches a position to turn on the pump. The pump may increase the pressure and move the button back to the compressed position, to turn off the pump.

The pump housing 58 may be constructed from a molded plastic material that has a number of cavity that align the switch P1, spring 68, plunger 70, set screw 72, etc.

The housing 58 may have a third cavity 74 located between the first 56 and second 60 cavities. The third cavity 74 provides a thermal barrier between the control circuit 30 in the first cavity 56 and the switch P1 in the second cavity 60. Additionally, the control circuit 30 is typically potted into the first cavity 56. Providing separate cavities prevents potting material from flowing into the second cavity 60 and interfering with the moving parts of the switch assembly. The use of a common housing 58 for both the pressure switch P1 and the control circuit 30 minimizes the wire length of the wires that connect the components and facilitate the assembly of the control circuit/switch assembly into the overall pump assembly.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A pump assembly, comprising:

a positive displacement pump that can create an output pressure, said positive displacement pump having a first cavity and a second cavity;

a motor that drives said pump;

a pulse width modulating circuit that is located in said first cavity and creates a plurality of pulses that provide energy to said motor; and, a pressure switch that is located within said second cavity and coupled to said pulse width modulating circuit and which can sense the output pressure, said pressure switch activating said pulse width modulating circuit when output pressure is less than a threshold value.

2. The pump assembly of claim 1, further comprising a current sensing circuit that varies the pulse energy as a function of the current drawn by said motor.

3. The pump assembly of claim 1, further comprising a thermal breaker coupled to said pulse width modulating circuit.

4. The pump assembly of claim 2, wherein said pulse width modulating circuit can provide a minimum pulse width.

5. The pump assembly of claim 1, wherein said pulse width modulating circuit includes an amplifier that receives a Varef input signal and Vsense input signal and provides an output signal to an input of a comparator, said comparator receiving a Vcref input signal and generates an output signal that creates the plurality of pulses.

6. The pump assembly of claim 1, wherein said a pulse width modulating circuit and said pressure switch are located within said positive displacement pump.

7. A pump assembly, comprising:

a pump that can create an output pressure;

a motor that draws a current and drives said pump;

a pulse width modulating circuit that creates a series of pulses that provide energy to said motor; and, a current sensing circuit that inversely varies the pulse energy as a function of an amplitude of the current drawn by said motor.

8. The pump assembly of claim 7, further comprising a thermal breaker coupled to said pulse width modulating circuit.

9. The pump assembly of claim 7, wherein said pulse width modulating circuit can provide a minimum pulse width.

10. The pump assembly of claim 7, wherein said pulse width modulating circuit includes an amplifier that receives a Varef input signal and Vsense input signal and provides an output signal to an input of a comparator, said comparator receiving a Vcref input signal and generates an output signal that creates a plurality of pulses that power said motor.

11. The pump assembly of claim 7, wherein said a pulse width modulating circuit and said current sensing circuit are located within said pump.

12. A method for operating a pump, comprising:

generating a plurality of pulses that drive a motor and a pump, said pulses providing an energy to the motor;

sensing a variation in an amplitude of a current drawn by the motor; and, inversely varying the pulse energy as a function of the variation in the amplitude of the current.

13. The method of claim 12, further comprising sensing a temperature of a control circuit and terminating the generation of pulses when the temperature exceeds a threshold value.

14. A pump assembly, comprising:

a motor;

a wobble plate coupled to said motor;

a diaphragm coupled to said wobble plate;

a piston coupled to said diaphragm;

a pump housing coupled to said piston, said diaphragm and said wobble plate, said pump housing having an outlet port;

a control circuit that is located within said pump housing and coupled to said motor; and, a pressure switch that is located within said pump housing adjacent to said output port, and is coupled to said control circuit.

15. The assembly of claim 14, wherein said control circuit is located within a first cavity of said pump housing and said pressure switch is located within a separate second cavity of said pump housing.

16. The assembly of claim 15, wherein said pump housing includes a third cavity located between said first and second cavities.

17. The assembly of claim 15, wherein said control circuit is podded into said first cavity.

18. The assembly of claim 14, further comprising a set screw located within said pump housing and adjustable to vary a threshold setting of said pressure switch.

19. A pump assembly, comprising:

a pump that can create an output pressure;

a motor that draws a current and drives said pump; and, a control circuit that creates a continuous signal to said motor when the current drawn by the motor is less than a threshold value, and switches to a pulsating regulation mode to provide a series of pulses to said motor when the current drawn by the motor exceeds the threshold value.

20. The assembly of claim 19, further comprising a diode coupled to said motor to allow a flow of current due to a back emf voltage of said motor.

21. The assembly of claim 19, wherein the threshold value is adjustable.

* * * * *